US008887539B1

(12) United States Patent
Hernandez

(10) Patent No.: US 8,887,539 B1
(45) Date of Patent: Nov. 18, 2014

(54) MANUAL LAUNDERING SYSTEM

(76) Inventor: Jose Hernandez, Boynton Beach, FL (US)

( * ) Notice: Subject to any disclaimer, the term of this patent is extended or adjusted under 35 U.S.C. 154(b) by 855 days.

(21) Appl. No.: 13/109,472

(22) Filed: May 17, 2011

(51) Int. Cl.
*D06F 5/02* (2006.01)

(52) U.S. Cl.
USPC ..... 68/57; 68/79; 68/89

(58) Field of Classification Search
CPC ..... D06F 5/02
USPC ..... 68/35, 36, 74, 79, 84, 89, 57
See application file for complete search history.

(56) References Cited

U.S. PATENT DOCUMENTS

| | | | | | |
|---|---|---|---|---|---|
| X6543 | I1 | * | 5/1831 | Crail | 366/276 |
| 16,203 | A | * | 12/1856 | Vertrees | 366/164.5 |
| 66,949 | A | * | 7/1867 | Cook | 366/276 |
| 627,297 | A | * | 6/1899 | Christman | 68/57 |
| 709,813 | A | * | 9/1902 | Brandt et al. | 68/79 |
| 828,170 | A | * | 8/1906 | Adams | 68/89 |
| 950,209 | A | * | 2/1910 | Paulus | 68/57 |
| 1,792,190 | A | * | 2/1931 | Dos Santos | 366/194 |
| 4,912,947 | A | * | 4/1990 | Dai | 68/23.7 |
| 5,704,281 | A | * | 1/1998 | Huang | 99/536 |
| 6,065,628 | A | * | 5/2000 | Page | 220/309.2 |
| 6,223,928 | B1 | * | 5/2001 | Sheran et al. | 220/495.11 |
| 2002/0170323 | A1 | * | 11/2002 | Stahl | 68/122 |
| 2005/0005655 | A1 | * | 1/2005 | Taylor | 68/215 |
| 2008/0223087 | A1 | * | 9/2008 | Veldman | 68/171 |
| 2010/0213107 | A1 | * | 8/2010 | Susnjara | 209/583 |

FOREIGN PATENT DOCUMENTS

| | | | |
|---|---|---|---|
| JP | 08299201 | A | * 11/1996 |
| JP | 2000333851 | A | * 12/2000 |
| JP | 2002136434 | A | * 5/2002 |
| JP | 2006247594 | A | * 9/2006 |

* cited by examiner

*Primary Examiner* — Joseph L Perrin
(74) *Attorney, Agent, or Firm* — Albert Bordas, P.A.

(57) ABSTRACT

A manual laundering system comprising a bucket, a lid, and a handle assembly. Dirty clothes/laundry, detergent, and water are placed inside the bucket. The handle assembly is positioned within the bucket. The lid is mounted to seal the bucket by passing an end of the handle assembly through the lid having a hole. Once sealed, the handle is moved to agitate the clothes/laundry, detergent, and water inside the bucket.

12 Claims, 4 Drawing Sheets

MANUAL LAUNDERING SYSTEM

BACKGROUND OF THE INVENTION

1. Field of the Invention

The present invention relates to laundering systems, and more particularly, to a portable laundering system that can be used where electricity is not accessible or available.

2. Description of the Related Art

Effective clothes washing assists in combating and reducing diseases. Prior art electric washing machines are convenient and effective. However, many people cannot afford electric washing machines. Also affected are millions of individuals living in third-world countries where electricity is not accessible or available. Such conditions may also exist for soldiers in war, and for people in places devastated by earthquakes, hurricanes and other natural disasters. Under such conditions, a common practice to clothes washing includes friction washing by hand, and/or with washboards, fences, or rocks in a body of water such as rivers or creeks if accessible. Applicant is not aware of any manual systems to effectively wash clothes comprising the novel features of the present invention.

SUMMARY OF THE INVENTION

It is one of the main objects of the present invention to provide a manual laundering system that is portable and that can be used where electricity is not accessible or available.

It is another object of the present invention to provide a manual laundering system that reduces the risk of diseases and encourages hygiene.

It is another object of the present invention to provide a manual laundering system that can used by people in places of war or places devastated by earthquakes, hurricanes and other natural disasters.

It is another object of the present invention to provide a manual laundering system that promotes good public health.

It is another object of the present invention to provide a manual laundering system that is much less abrasive than hand washing and reduces wear of clothes.

It is yet another object of the present invention to provide a manual laundering system that is of high-grade material and certified as water and food storage containers by the UN, USDT, and the USDA.

It is yet another object of the present invention to provide a manual laundering system that is of high-density polyethylene material which is UN stamped and meets NMFC, FDA, and UFC requirements for safe storage of food and water to further assist in relief aid.

It is yet another object of the present invention to provide a manual laundering system that is of high-density polyethylene material which is UN stamped in the color of camouflage and/or OD green for military purposes.

It is yet another object of the present invention to provide a manual laundering system that is of an economical high-density polyethylene material which is UN stamped or green post consumer material.

It is yet another object of the present invention to provide a manual laundering system, which buckets posses a child-warning label in various languages.

It is yet another object of the present invention to provide a manual laundering system, which lid is available with a rubber gasket seal or of the "Easy Off" kind, in a color or clear to allow viewing of laundry.

It is yet another object of the present invention to provide a manual laundering system, which lid is intended to reduce spillage.

It is yet another object of the present invention to provide a manual laundering system that can be used for camping, survival packs, boats, recreational vehicles, apartments, and while traveling.

It is yet another object of the present invention to provide a manual laundering system that can be used for the purpose of promoting "Green" energy.

It is yet another object of the present invention to provide a manual laundering system that can be used for pre-washing heavily soiled or contaminated laundry.

It is yet another object of the present invention to provide a manual laundering system that can be used for the purpose of washing a small amount (load) of laundry.

It is yet another object of the present invention to provide a manual laundering system that can be used for the purpose of washing work or mechanics towels/rags.

It is yet another object of this invention to provide a manual laundering system that is volumetrically efficient for carrying, transporting, and storage.

It is still another object of this invention to provide a manual laundering system that can be readily assembled and disassembled without the need of any special tools.

It is still another object of this invention to provide a manual laundering system, which is of a durable and reliable construction.

It is still another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
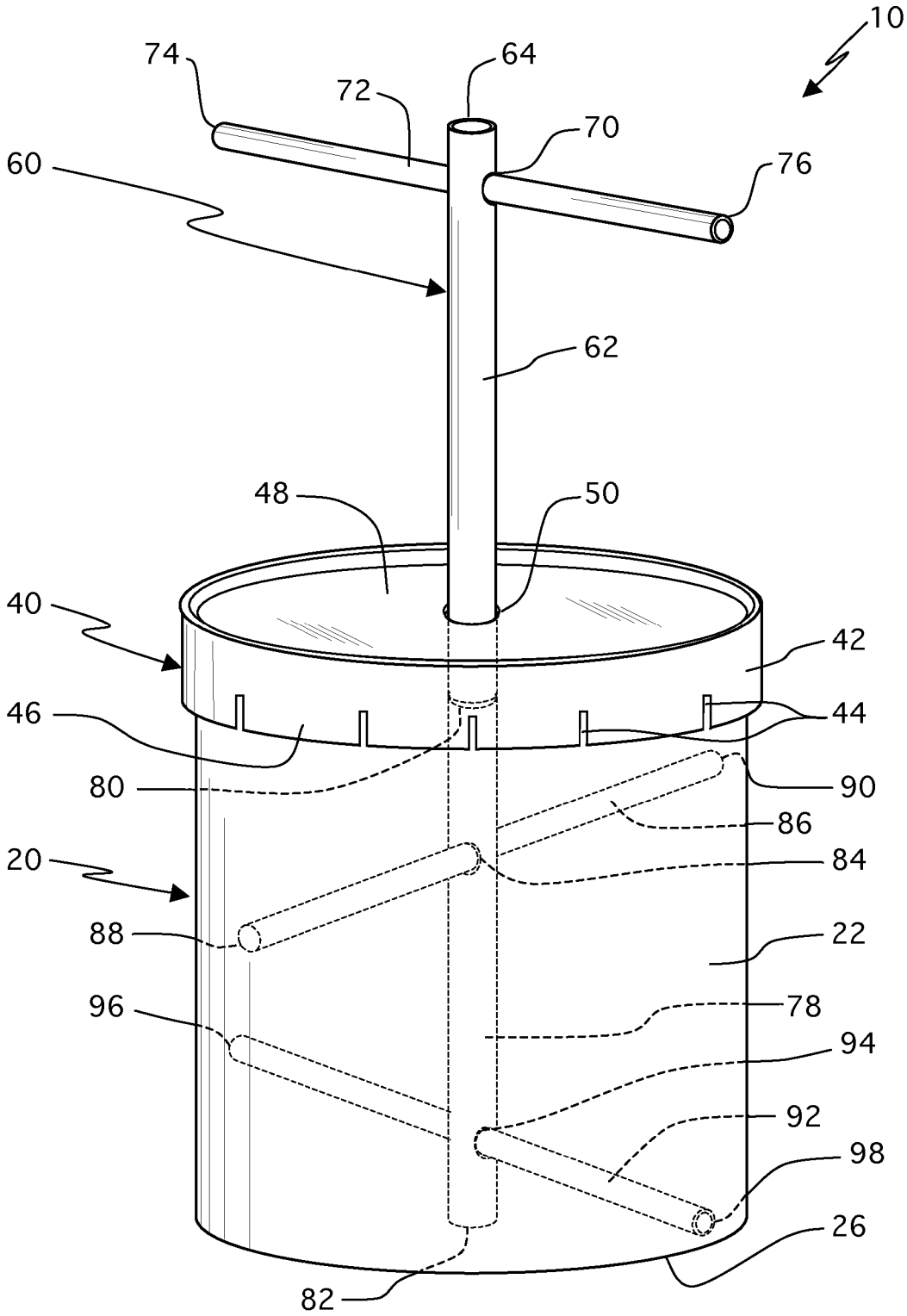
FIG. 1 is an isometric view of the present invention.

Referring now to the drawings, the present invention is a manual laundering system and is generally referred to with numeral 10. It can be observed that it basically includes bucket 20, lid 40, and handle assembly 60.

As seen in FIG. 1, lid 40 mounts upon to seal bucket 20. In use, handle assembly 60 comprises handle shaft 62 snugly fitted into hole 50 of lid 40.

Figure 2:
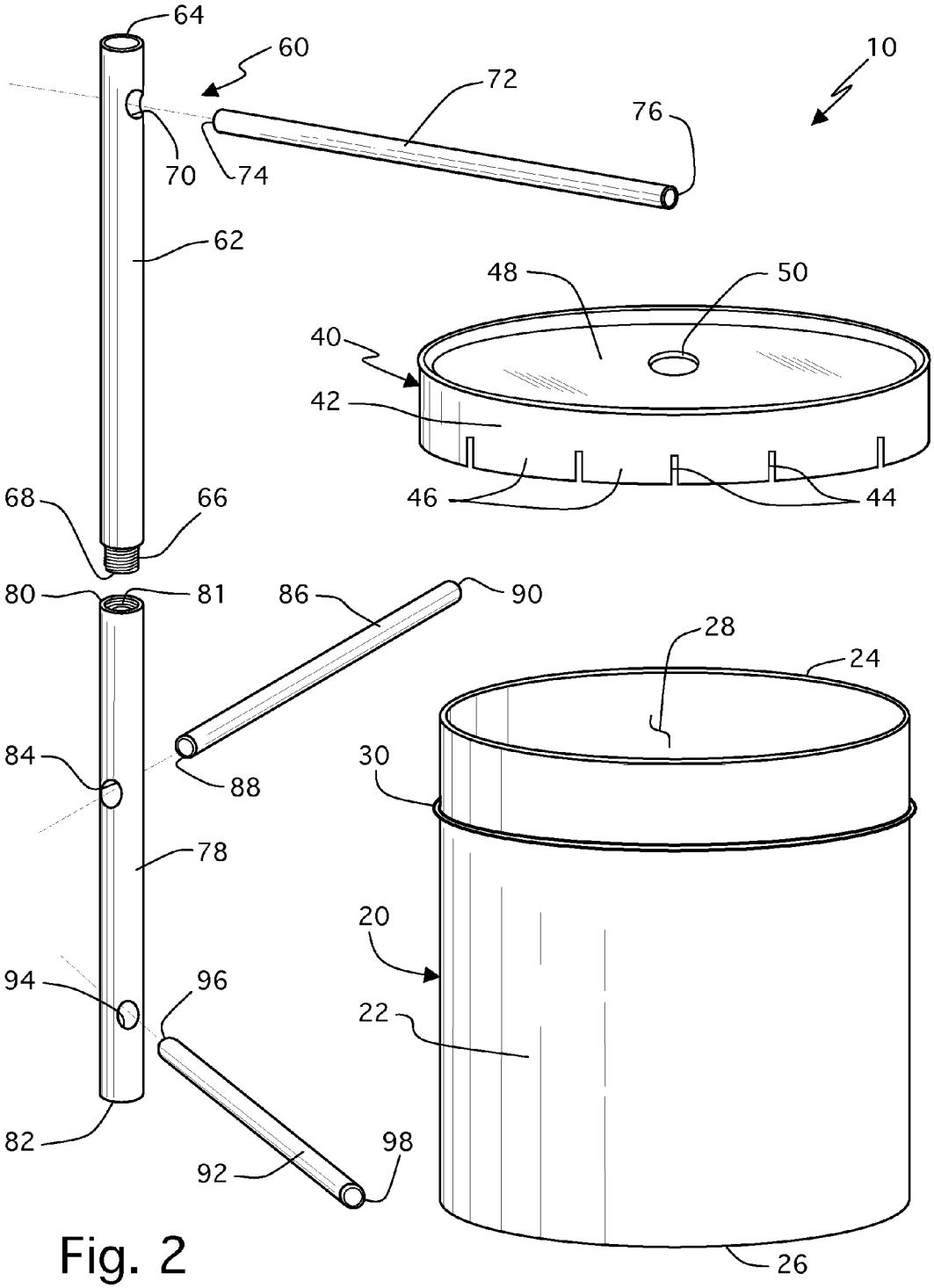
FIG. 2 is an exploded view of the present invention.

As seen in FIG. 2, in a preferred embodiment, bucket 20 comprises sidewall 22 having top edge 24 and base 26 to define cavity 28. A ridge, such as ridge 30 can be externally mounted around sidewall 22 at a predetermined distance from edge 24. Bucket 20, also called a pail, is defined as a watertight, vertical cylinder or truncated cone, with an open top and a flat bottom, usually attached to a semicircular carrying handle called a bail. However, bucket 20 may also be of other shapes such as, but not limited to, square, octagon, hexagon, etc. Furthermore, bucket 20 may also be transparent.

Lid 40 is a removable lid and has a cooperative dimension and shape to be mounted over edge 24. Lid 40 comprises sidewall 42. In a preferred embodiment, sidewall 42 comprises a plurality of slits 44 to define tabs 46. Lid 40 also comprises top wall 48 having perforated knockout hole 50, which may be positioned centrally thereon. Lid 40 may comprise other components to assist lid 40 seal upon bucket 20.

Handle assembly 60 comprises handle shaft 62 and agitator shaft 78. Handle shaft 62 comprises ends 64 and 68. Male threaded section 66 extends a first predetermined distance from end 68 without reaching end 64. Handle shaft 62 further comprises at least one through hole 70 positioned between ends 64 and 68. Handle 72 has ends 74 and 76, and snugly fits within through hole 70.

Agitator shaft 78 comprises ends 80 and 82. Female threaded section 81 extends a second predetermined distance from end 80 without reaching end 82. Agitator shaft 78 further comprises at least one through hole 84 positioned between ends 80 and 82, and in a preferred embodiment, agitator shaft 78 also comprises through hole 94 positioned between through hole 84 and end 82. Upper agitator 86 has ends 88 and 90 and snugly fits within through hole 84. Lower agitator 92 has ends 96 and 98 and snugly fits within through hole 94.

Figure 3:
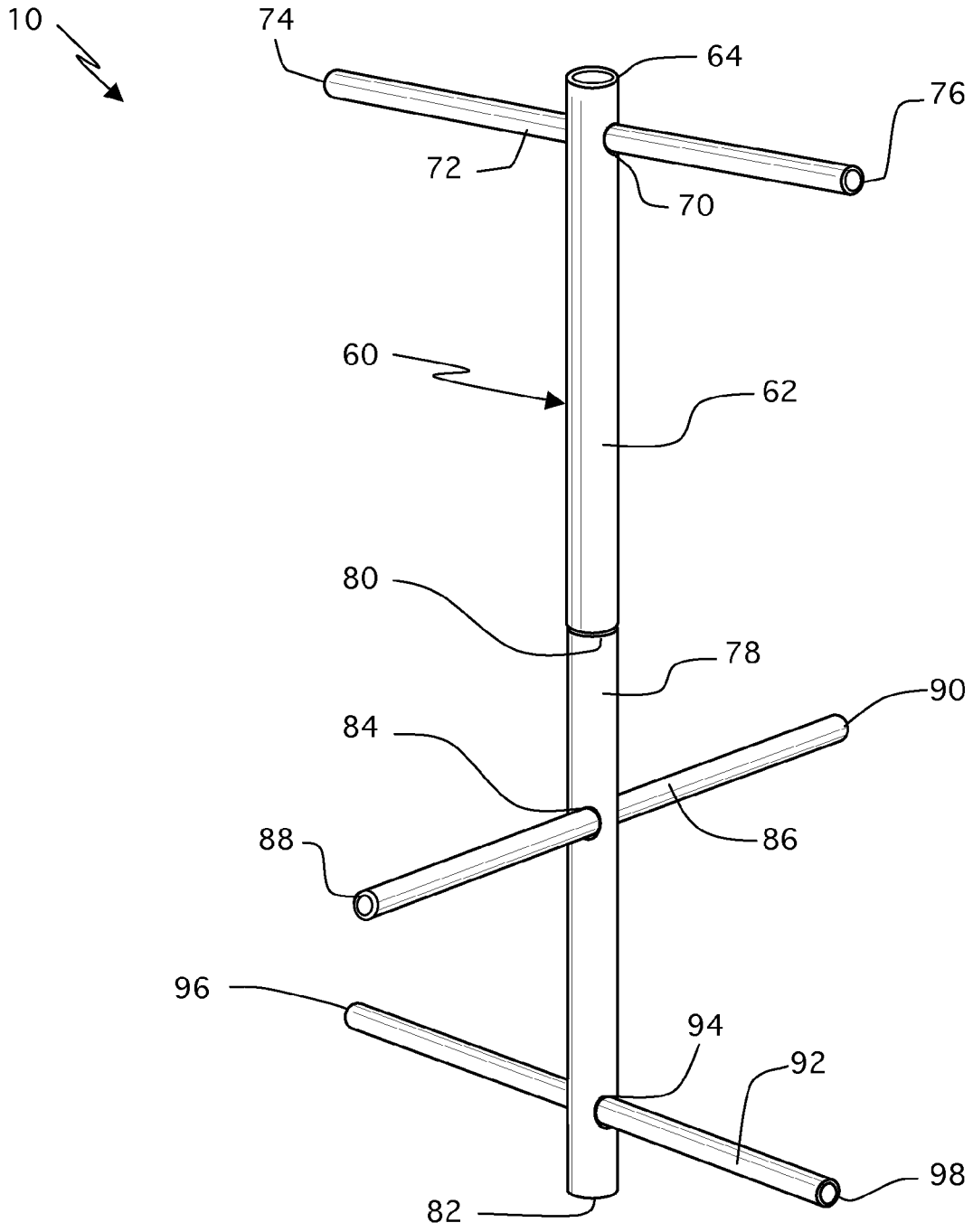
FIG. 3 is an isometric view of an assembled handle assembly.

As best seen in FIG. 3, handle shaft 62 is mounted upon agitator shaft 78 by screwing male threaded section 66 into female threaded section 81. Upper agitator 86 is snugly fit within through hole 84, and preferably equidistant between ends 88 and 90. Lower agitator 92 is snugly fit within through hole 94, and preferably equidistant between ends 96 and 98. Upper and lower agitators 86 and 92 may be at a predetermined angle with respect to each other, and preferably are perpendicular with respect to agitator shaft 78.

Figure 4:
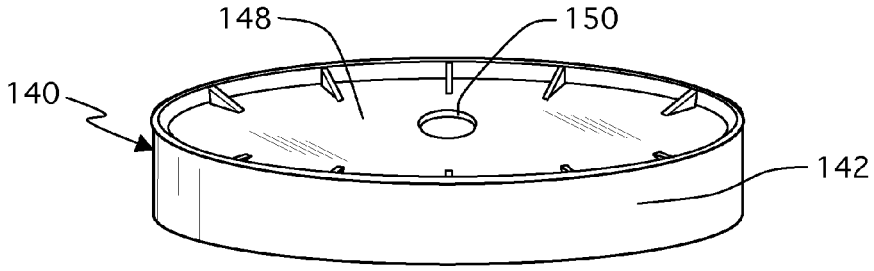
FIG. 4 is an isometric view of an alternate embodiment for the lid.

Seen in FIG. 4 is lid 140 as an alternate embodiment for lid 40. Lid 140 is a removable lid and has a cooperative dimension and shape to be mounted over edge 24. Lid 140 comprises sidewall 142 and top wall 148 having perforated knockout hole 150, which may be positioned centrally thereon. Lid 140 may comprise other components to assist lid 140 seal upon bucket 20.

In operation, a user places dirty clothes/laundry, detergent, and water inside bucket 20. Handle assembly 60, with upper and lower agitators 86 and 92 snugly fitted therein, is positioned within bucket 20. Lid 40 is mounted to seal bucket 20 by passing end 64 through perforated knockout hole 50. Once sealed, handle 72 is snugly fit within through hole 70, and preferably equidistant between ends 74 and 76, as seen in FIGS. 1 and 3.

The user then agitates the clothes/laundry, detergent, and water inside bucket 20 by manually moving handle assembly 60. Manually moving can be, as an example, moving handle 72 in clockwise and counter-clockwise directions while raising and lowering the handle 72.

It is important to note that instant invention 10 completely disassembles as seen in FIG. 2, making it volumetrically efficient for carrying, transporting, and storage, and can also be readily assembled and disassembled without the need of any special tools. Present invention 10 can be used where electricity is not accessible or available, reduces the risk of diseases and encourages hygiene, and can used by people in places of war or places devastated by earthquakes, hurricanes and other natural disasters. Present invention 10 also promotes good public health.

Furthermore, each component identified above of present invention 10 can be color-coded or numbered to identify the positions for each respective component. In addition, each component can have arrows to identify the position and indicate each insertion location. As an example, handle 72 can be color-coded yellow to snugly fit within through hole 70 also color-coded yellow; upper agitator 86 can be color-coded blue to snugly fit within through hole 84 also color-coded blue; and lower agitator 92 can be color-coded green to snugly fit within through hole 94 also color-coded green.

In a preferred embodiment, present invention 10 is manufactured of a high-grade material certified as water and food storage containers by the United Nations, United States Department of Transportation, and the United States Department of Agriculture, which is also of a durable and reliable construction. Therefore, present invention 10 can be used for camping, survival packs, boats, recreational vehicles, apartments, and while traveling.

Summarizing, it is therefore one of the main objects of the present invention 10 to provide a manual laundering system that is portable and that can be used where electricity is not accessible or available. It is another object of the present invention 10 to provide a manual laundering system that reduces the risk of diseases and encourages hygiene. It is another object of the present invention 10 to provide a manual laundering system that can used by people in places of war or places devastated by earthquakes, hurricanes and other natural disasters. It is another object of the present invention 10 to provide a manual laundering system that promotes good public health. It is another object of the present invention 10 to provide a manual laundering system that is much less abrasive than hand washing and reduces wear of clothes. It is yet another object of the present invention 10 to provide a manual laundering system that is of high-grade material and certified as water and food storage containers by the UN, USDT, and the USDA. It is yet another object of the present invention 10 to provide a manual laundering system that is of high-density polyethylene material which is UN stamped and meets NMFC, FDA, and UFC requirements for safe storage of food and water to further assist in relief aid. It is yet another object of the present invention 10 to provide a manual laundering system that is of high-density polyethylene material which is UN stamped in the color of camouflage and/or OD green for military purposes. It is yet another object of the present invention 10 to provide a manual laundering system that is of an economical high-density polyethylene material which is UN stamped or green post consumer material. It is yet another object of the present invention 10 to provide a manual laundering system, which buckets posses a child-warning label in various languages. It is yet another object of the present invention 10 to provide a manual laundering system, which lid is available with a rubber gasket seal or of the "Easy Off" kind, in a color or clear to allow viewing of laundry. It is yet another object of the present invention 10 to provide a manual laundering system, which lid is intended to reduce spillage. It is yet another object of the present invention 10 to provide a manual laundering system that can be used for camping, survival packs, boats, recreational vehicles, apartments, and while traveling. It is yet another object of the present invention 10 to provide a manual laundering system that can be used for the purpose of promoting "Green" energy. It is yet another object of the present invention 10 to provide a manual laundering system that can be used for pre-washing heavily soiled or contaminated laundry. It is yet another object of the present invention 10 to provide a manual laundering system that can be used for the purpose of washing a small amount (load) of laundry. It is yet another object of the present invention 10 to provide a manual laundering system that can be used for the purpose of washing work or mechanics towels/rags. It is yet another object of the present invention 10 to provide a manual laundering system that is volumetrically efficient for carrying, transporting, and storage. It is still another object of the present invention 10 to provide a manual laundering system that can be readily assembled and disassembled without the need of any special tools. It is still another object of the present invention 10 to provide a manual laundering system, which is of a durable and reliable construction. It is still another object of this invention to provide such a device that is inexpensive to manufacture and maintain while retaining its effectiveness.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A laundering apparatus, comprising:

A) a bucket comprising a first sidewall having a top edge and base to define a cavity;

B) a removable lid that mounts upon to seal said bucket having a cooperative dimension and shape to be mounted over said top edge, said lid comprises a second sidewall having a plurality of slits to define tabs, said lid also comprises a top wall having a knockout hole; and C) a handle assembly comprising a handle shaft, an agitator shaft, and a handle, said handle shaft is snugly fitted into said knockout hole, said handle shaft comprises first and second ends, a male threaded section extends a first predetermined distance from said first end without reaching said second end, said handle shaft further comprises a first at least one through hole positioned between said first and second ends, said handle has third and fourth ends and snugly fits within said first at least one through hole, said agitator shaft comprises fifth and sixth ends, a female threaded section extends a second predetermined distance from said fifth end without reaching said sixth end, said agitator shaft further comprises a second at least one through hole positioned between said fifth and sixth ends, said agitator shaft further comprises a third at least one through hole positioned between said second at least one through hole and said sixth end, said agitator shaft further comprises an upper agitator having seventh and eighth ends that fits within said second at least one through hole, and a lower agitator having ninth and tenth ends that fits within said third at least one through hole, said bucket, said removable lid, and said handle assembly comprising said handle shaft having said handle, and said agitator shaft having said upper and lower agitators are readily assembled and disassembled without the need of any special tools making it volumetrically efficient for carrying, transporting, and storage.

2. The laundering apparatus set forth in claim 1, further characterized in that a ridge is externally mounted around said first sidewall at a second predetermined distance from said top edge.

3. The laundering apparatus set forth in claim 1, further characterized in that said bucket is transparent.

4. The laundering apparatus set forth in claim 1, further characterized in that said knockout hole is positioned centrally on said removable lid.

5. The laundering apparatus set forth in claim 1, further characterized in that said handle shaft is mounted upon said agitator shaft by screwing said male threaded section into said female threaded section.

6. The laundering apparatus set forth in claim 1, further characterized in that said upper agitator fits within said second at least one through hole, equidistant between said seventh and eighth ends.

7. The laundering apparatus set forth in claim 1, further characterized in that said lower agitator fits within said third at least one through hole, and equidistant between said ninth and tenth ends.

8. The laundering apparatus set forth in claim 1, further characterized in that said upper and lower agitators are at a predetermined angle with respect to each other, and perpendicular with respect to said agitator shaft.

9. The laundering apparatus set forth in claim 1, further characterized in that said bucket, said removable lid, and said handle assembly are color-coded or numbered to identify the positions for each respective component.

10. The laundering apparatus set forth in claim 1, further characterized in that said bucket, said removable lid, and said handle assembly comprise arrows to identify position and indicate insertion locations for each component of said bucket, said removable lid, and said handle assembly.

11. A laundering apparatus, comprising:

A) a bucket comprising a first sidewall having a top edge and base to define a cavity;

B) a removable lid that mounts upon to seal said bucket having a cooperative dimension and shape to be mounted over said top edge, said lid comprises a second sidewall having a plurality of slits to define tabs, said lid also comprises a top wall having a knockout hole; and C) a handle assembly comprising a handle shaft, an agitator shaft, and a handle, said handle shaft is snugly fitted into said knockout hole and comprises first and second ends, a male threaded section extends a first predetermined distance from said first end without reaching said second end, said handle shaft further comprises a first at least one through hole positioned between said first and second ends, said handle has third and fourth ends and snugly fits within said first at least one through hole, said agitator shaft comprises fifth and sixth ends, a female threaded section extends a second predetermined distance from said fifth end without reaching said sixth end, said agitator shaft further comprises a second at least one through hole positioned between said fifth and sixth ends, said agitator shaft further comprises a third at least one through hole positioned between said second at least one through hole and said sixth end, said agitator shaft further comprises an upper agitator having seventh and eighth ends that fits within said second at least one through hole, and a lower agitator having ninth and tenth ends that fits within said third at least one through hole, said handle shaft is mounted upon said agitator shaft by screwing said male threaded section into said female threaded section, said upper agitator fits within said second at least one through hole, equidistant between said seventh and eighth ends, said lower agitator fits within said third at least one through hole, and equidistant between said ninth and tenth ends, said bucket, said removable lid, and said handle assembly comprising said handle shaft having said handle, and said agitator shaft having said upper and lower agitators are readily assembled and disassembled without the need of any special tools making it volumetrically efficient for carrying, transporting, and storage.

12. The laundering apparatus set forth in claim 11, further characterized in that said upper and lower agitators are at a predetermined angle with respect to each other and perpendicular with respect to said agitator shaft; said bucket, said removable lid, and said handle assembly are color-coded or numbered to identify the positions for each respective component, said bucket, said removable lid, and said handle assembly comprise arrows to identify position and indicate insertion locations for each component of said bucket, said removable lid, and said handle assembly.

* * * * *